United States Patent [19]

Nanda et al.

[11] Patent Number: 4,611,528

[45] Date of Patent: Sep. 16, 1986

[54] POWER TRANSMISSION

[75] Inventors: Vinod K. Nanda, Rochester; Henry D. Taylor, Pontiac, both of Mich.

[73] Assignee: Vickers, Incorporated, Troy, Mich.

[21] Appl. No.: 786,724

[22] Filed: Oct. 15, 1985

Related U.S. Application Data

[63] Continuation of Ser. No. 605,607, Apr. 30, 1984, abandoned, which is a continuation-in-part of Ser. No. 320,448, Nov. 12, 1981, abandoned.

[51] Int. Cl.[4] ..... F15B 13/042

[52] U.S. Cl. ..... 91/442; 91/446; 91/455; 91/457; 91/461; 137/596.15

[58] Field of Search ..... 91/445, 420, 442, 268, 91/453, 367, 452, 468, 461, 444, 446, 455, 457; 137/596.14, 596.15

[56] References Cited

U.S. PATENT DOCUMENTS

| | | | |
|---|---|---|---|
| 3,788,401 | 1/1974 | Scheidt et al. | 91/445 |
| 3,906,840 | 9/1975 | Bianchetta et al. | 91/445 |
| 4,201,052 | 5/1980 | Breeden et al. | 91/461 |
| 4,206,688 | 6/1980 | Haak et al. | 91/461 |
| 4,342,256 | 8/1982 | Andersen et al. | 91/420 |
| 4,407,122 | 10/1983 | Nanda | 91/461 |

*Primary Examiner*—Robert E. Garrett
*Assistant Examiner*—Richard S. Meyer
*Attorney, Agent, or Firm*—Barnes, Kisselle, Raisch, Choate, Whittemore & Hulbert

[57] ABSTRACT

A hydraulic control system comprising a hydraulic actuator having opposed openings adapted to alternately function as inlets and outlets for moving the element of the actuator in opposite directions and a variable displacement pump with loading sensing control for supplying fluid to said actuator. A pilot pressure operated meter-in valve is provided to which the fluid from the pump is supplied and pilot pressure is applied to the meter-in valve for controlling the direction and displacement of movement of the meter-in valve and the direction and velocity of the actuator. A pair of lines extends from the meter-in valve to the respective openings of the actuator and a pilot pressure operated meter-out valve is associated with each line of the actuator for controlling the flow out of the actuator when that line to the actuator does not have pressure from from the pump applied thereto. A spring loaded poppet valve is associated with each line and a passage extends from at least one of the poppet valves to the meter-out valve and operable, when the meter-out valve is closed after being open, to reduce the pressure holding the spring loaded poppet valve closed, thereby permitting the spring loaded poppet valve to open at a relatively low pressure developed in one of the lines associated with the one meter-out valve, thereby allowing the one meter-out valve to open.

3 Claims, 9 Drawing Figures

POWER TRANSMISSION

This application is a continuation of application Ser. No. 605,607, filed Apr. 30, 1984, now abandoned, which was, in turn, a continuation-in-part of application Ser. No. 320,448, filed Nov. 12, 1981, now abandoned.

This invention relates to power transmissions in hydraulic systems that are found, for example, on mobile equipment such as excavators and cranes.

BACKGROUND AND SUMMARY OF THE INVENTION

In U.S. Pat. No. 4,201,052, incorporated herein by reference, there is disclosed a pilot pressure operated high pressure load sensing valve system incorporated in a valve body designed to be mounted directly on an actuator to be controlled such as a hydraulic cylinder or hydraulic motor. The valve system accurately controls the position and speed of operation of the actuator.

In brief, the valve system disclosed in the aforementioned patent comprises an independent pilot operated meter-in element; a pair of load drop check valves; a pair of independently operated normally closed meter-out elements; a pair of load pressure responsive valves; and a pair of anti-cavitation valves. The meter-in element functions to direct fluid flow to one or the other of the actuator ports. The normally closed meter-out elements are associated with each of the actuator ports for controlling fluid flow from the port opposite to the actuator port to which the meter-in element is directing fluid. The meter-out elements function as variable orifices metering fluid between the appropriate actuator port and a low pressure zone such as a reservoir tank. Each of the meter-out elements has associated therewith the load pressure responsive valves which act on the meter-out elements in response to load pressure to enable the meter-out elements to also provide pressure relief protection. The anti-cavitation valves are associated with each of the actuator ports and are adapted to open the appropriate port to tank.

The valve system is directly mounted to the actuator port manifold and is supplied by one full flow high pressure line, a pair of pilot pressure lines, and a load sensing line. The operation of the valve system is controlled through the pilot lines from a manually operated hydraulic remote control valve. In the absence of a command signal from the hydraulic remote control, the meter-in element assumes a centered or neutral position with the check valves, the meter-out elements, the pressure responsive valves, and the anti-cavitation valves, all in closed position. In the neutral position, the valve system prevents uncontrolled lowering of loads and in the case of overrunning loads, prevents fluid flow from the high pressure fluid source to the actuator even in the event of a ruptured line. Since the valve system is a load sensing system, the pump output is made to match that which is required by the load. In contrast, in a non-load sensing system, the pump output may exceed that required by the load with the excess power being dissipated as heat.

Under certain conditions, it may not be possible or desirable to mount the valve system directly to an actuator. Such conditions may exist due to space limitations on the actuator or where it is desirable to limit the number of supply and pilot lines, such as to the topmost section of a telescoping boom or when a brake, such as in a winch-type application, is required between the actuator and valve system. Under these conditions, the valve system is mounted on the equipment remote from the actuator with a pair of lines running to the actuator port manifold. In one of these situations, it may be desirable to interpose a conventional counterbalance valve between one of the actuator port lines and the valve system. The counterbalance valve provides for controlled lowering and holding of the load at the actuator port manifold.

In another situation when a stable load is involved, it may be desirable to interpose a pilot operated check valve between the actuator port and the valve system. The pilot operated check valve provides for positive holding of the load, that is, holding the load stable with zero drift.

Also, in many applications, the need arises for a linear hydraulic cylinder to have a float position or a rotary hydraulic motor to have a free swing or coast position. In either of these applications, the implement at the end of the cylinder or a swing drive for a boom are allowed to coast to a stop due to frictional forces in the system.

The valve system disclosed in the aforementioned patent does not lend itself to use in the circuit applications mentioned above; namely, the use of counterbalance valves, pilot operated check valves, brakes and free float or swing of the actuator. This is mainly due to the normally closed condition of the meter-out valve elements.

Accordingly, it is an object of the present invention to provide a valve system of the aforementioned type which is operable with the use of counterbalance valves, pilot operated check valves, brakes and free floating or swinging actuators.

In accordance with the invention, the above described control valve system is provided with a pair of normally open exhaust valves positioned between a tank passage and actuator ports so that with the meterin valve in the neutral position, both actuator ports are open to the tank passage through the normally open meter-out valves and the actuator will be free to move as, for example, in the case of a free coasting boom. However, when a pilot signal is applied to the meterin valve to move the actuator in one direction, pilot pressure is also applied to close the appropriate exhaust valve preventing flow of fluid from the pump to the tank passage with the other exhaust valve remaining open to the tank passage. Where a counterbalance valve is utilized in association with one opening of an actuator for controlling lowering and holding of a load, a single normally open exhaust valve is provided between that actuator opening and the tank passage. Where an external brake is provided for holding a load, a single normally open exhaust valve is also provided between the actuator opening and the tank passage.

In accordance with another aspect of the invention, the control valve system is of the type described above with reference to U.S. Pat. 4,201,052 utilizing a pair of normally closed meter-out valves. Where a free coast function is desired, a passage is provided from the output of the meter-in valve such that when a pilot signal is provided to the meter-in valve to apply pressure to one actuator opening to move the actuator in one direction, the exhaust pressure from the other actuator opening through the passage functions to open the meter-out valve associated with the other opening of the actuator to open that meter-out valve and provide a free coast mode.

DESCRIPTION

Figure 1:
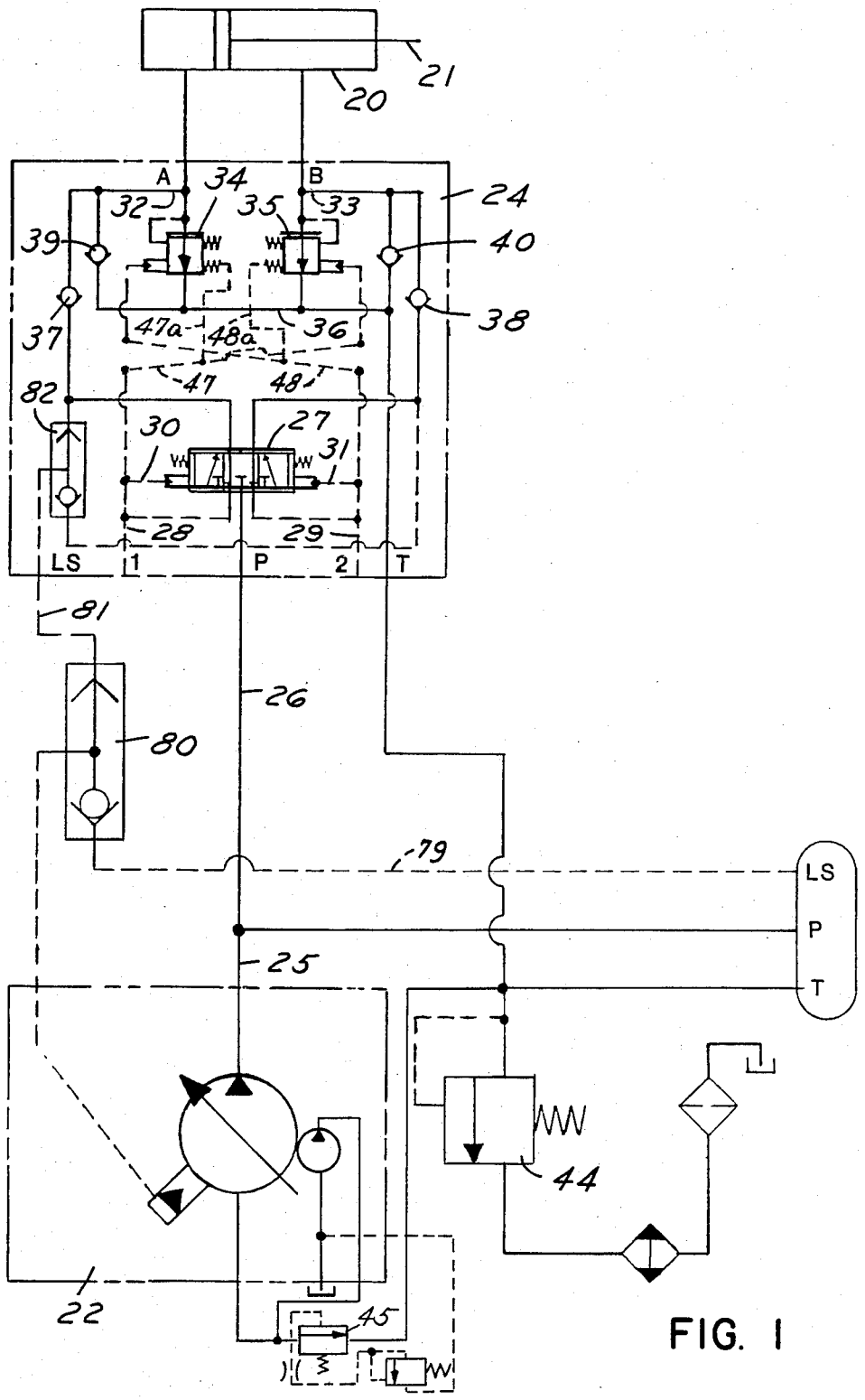
FIG. 1 is a schematic drawing of the hydraulic circuit embodying the invention.

Referring to FIG. 1, the hydraulic system embodying the invention comprises an actuator 20, herein shown as a linear hydraulic cylinder, having an output shaft 21 that is moved in opposite directions by hydraulic fluid supplied from a variable displacement pump system 22 which has load sensing control in accordance with conventional construction. The hydraulic system further includes a manually operated controller, not shown, that direct a pilot pressure to a valve system 24 for controlling the direction of movement of the actuator, as presently described. Fluid from the pump 22 is directed to the line 25 and line 26 to a meter-in valve 27 that functions to direct and control the flow of hydraulic fluid to one or the other end of the actuator 20. The meter-in valve 27 is pilot pressure controlled by controller, not shown, through lines 28, 29 and lines 30, 31 to the opposed ends thereof, as presently described. Depending upon the direction of movement of the valve, hydraulic fluid passes through lines 32, 33 to one or the other end of the actuator 20.

The hydraulic system further includes a normally-open exhaust valve 34, 35 positioned between each end of the actuator in lines 32, 33 and a tank passage 36. The exhaust valves control the flow of fluid between the actuator and tank passage 36, as presently described.

The hydraulic system further includes spring loaded poppet valves 37, 38 in the lines 32, 33 and spring-loaded anti-cavitation valves 39, 40 which are adapted to open the lines 32, 33 to the tank passage 36. In addition, spring-loaded poppet valves, in FIGS. 1–5 are associated with each valve 34, 35 acting as pilot operated relief valves. A line 47 connects meter-out valve 34 with pilot control line 28 and a line 48 connects valve 35 with pilot control line 29 so that when pilot pressure is applied to one side of meter-in valve 27, the appropriate valve 34, 35 is closed.

The system also includes a back pressure valve 44 associated with the return or tank line. Back pressure valve 44 functions to minimize cavitation when an overrunning or a lowering load tends to drive the actuator down. A charge pump relief valve 45 is provided to take excess flow above the inlet requirements of the pump 22 and apply it to the back pressure valve 44 to augment the fluid available to the actuator.

Meter-in valve 27 comprises a bore in which a spool is positioned and in the absence of pilot pressure the spool is maintained in a neutral position by springs. The spool normally blocks the flow from the pressure passage 26 to the passages 32, 33. When pilot pressure is applied to either end of the spool, the spool moves until a force balance exists among the pilot pressure, the spring load and the flow forces. The direction of movement determines which of the passages 32, 33 is provided with fluid under pressure from passage 26.

When pilot pressure is applied to either line 28 or 29, leading to exhaust valves 34 or 35, the valve is actuated to block flow from the pressurized line 32 or 33 to tank passage 36.

It can thus be seen that the same pilot pressure which functions to determine the direction of opening of the meter-in valve and therefor the direction of movement of the actuator also functions to close the appropriate exhaust valve so that the fluid will flow into the actuator. The opposite exhaust valve is not acted on by the pilot pressure therefor remaining open to the tank passage and allowing fluid from the opposite end of the actuator to flow to tank.

Provision is made for sensing the maximum load pressure in one of a multiple of valve systems 24 controlling a plurality of actuators and applying the higher pressure to the load sensitive variable displacement pump 22. Each valve system 24 includes a line 81 extending to a shuttle valve 80 that receives load pressure from an adjacent actuator through line 79. Shuttle valve 80 senses which of the pressures is greater and shifts to apply the higher pressure to pump 22. Thus, each valve system in succession incorporates shuttle valves 80, 82 which compare the load pressure therein with the load pressure of an adjacent valve system and transmit the higher pressure to the adjacent valve system in succession and finally apply the highest load pressure to pump 22.

The single meter-in valve 27 may be replaced by two meter-in valves as shown in copending application Ser. No. 117,936 filed Feb. 4, 1980, now U.S. Pat. No.4,480,527 and having a common assignee with the instant application.

The details of the preferred construction of the other elements of the hydraulic circuit are more specifically described in the aforementioned U.S. Pat. No. 4,201,052.

Figure 2:
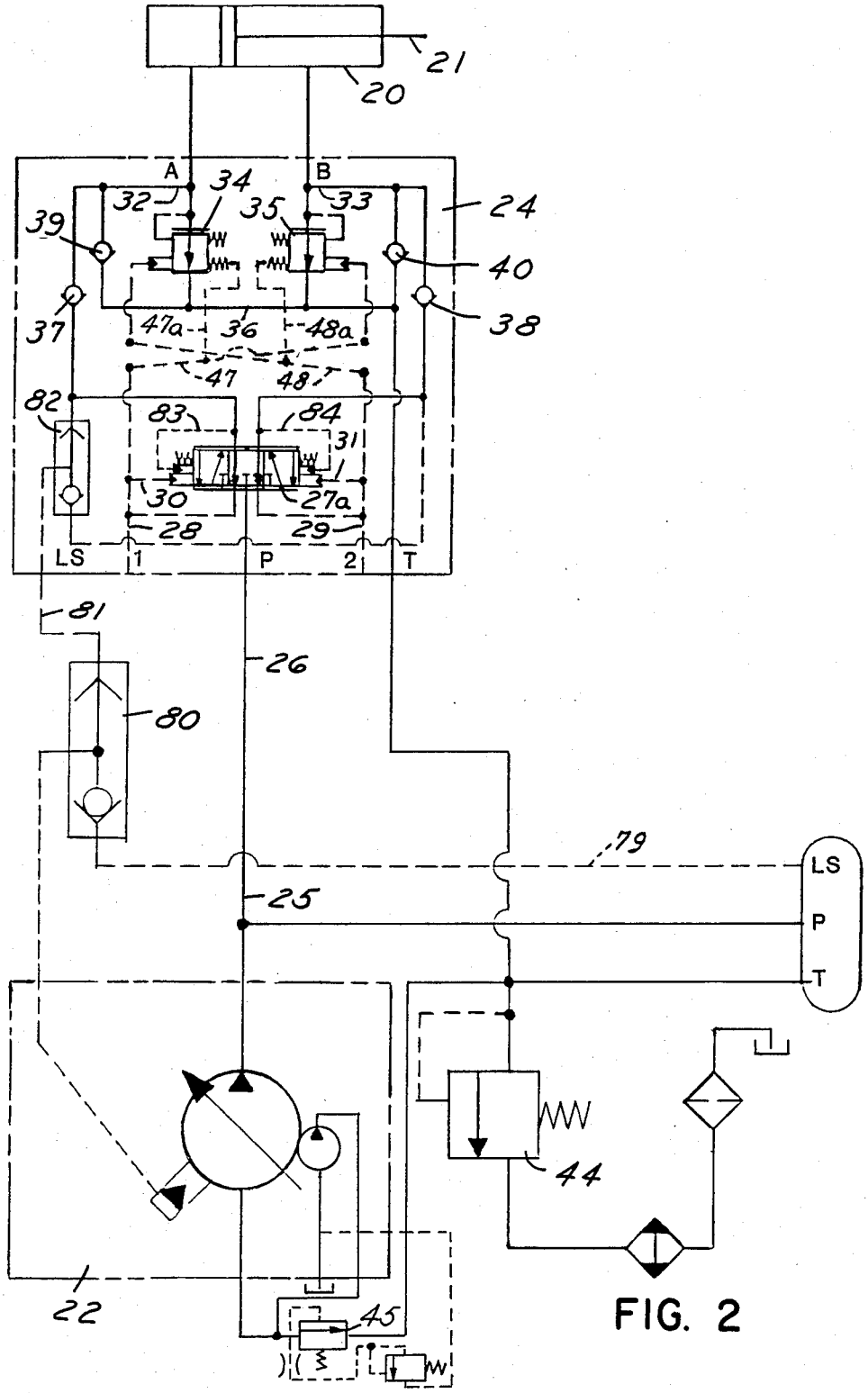
FIG. 2 is a schematic drawing of another modified hydraulic circuit.
Figure 3:
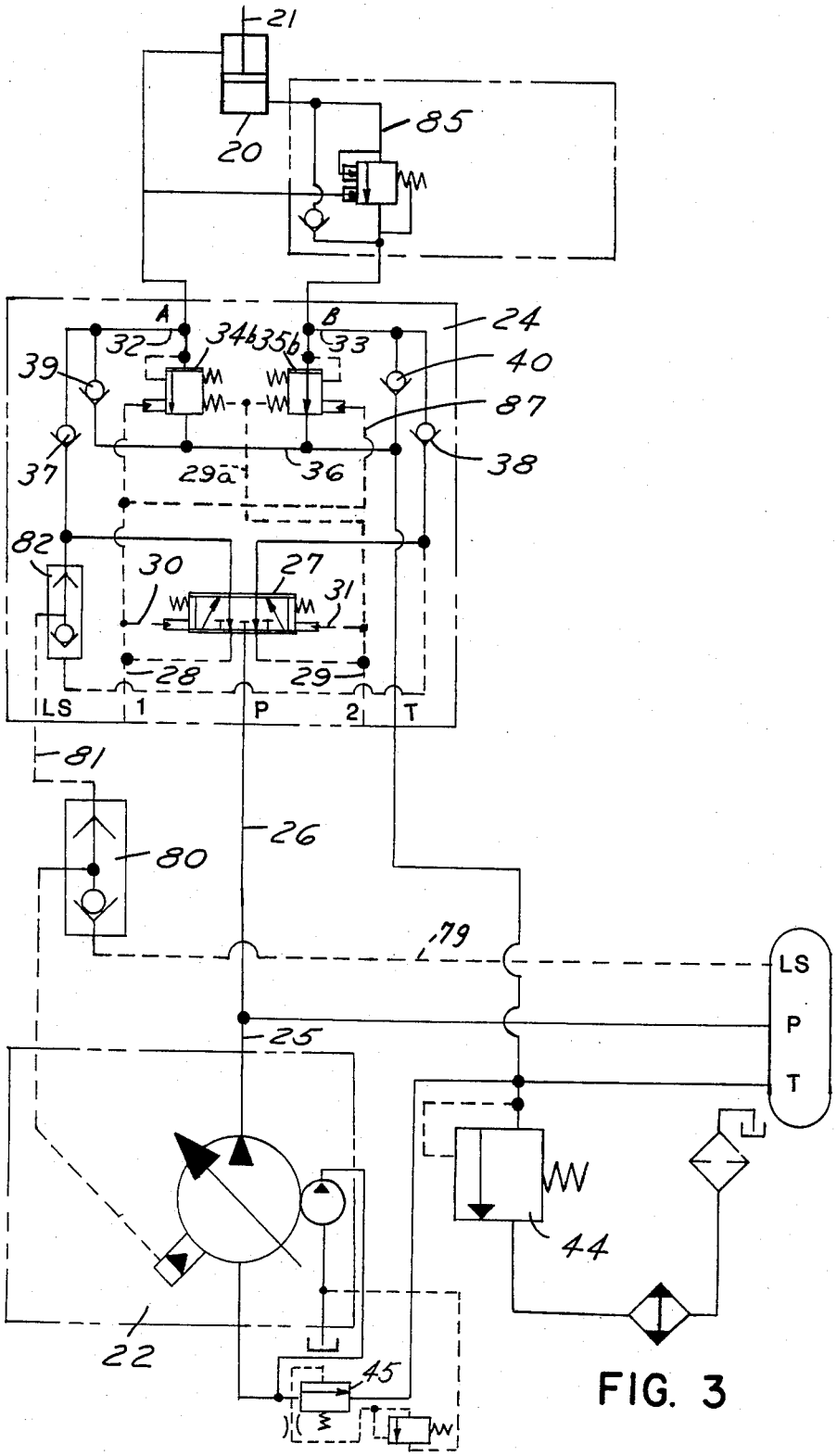
FIG. 3 is a schematic drawing of another modified hydraulic circuit.
Figure 4:
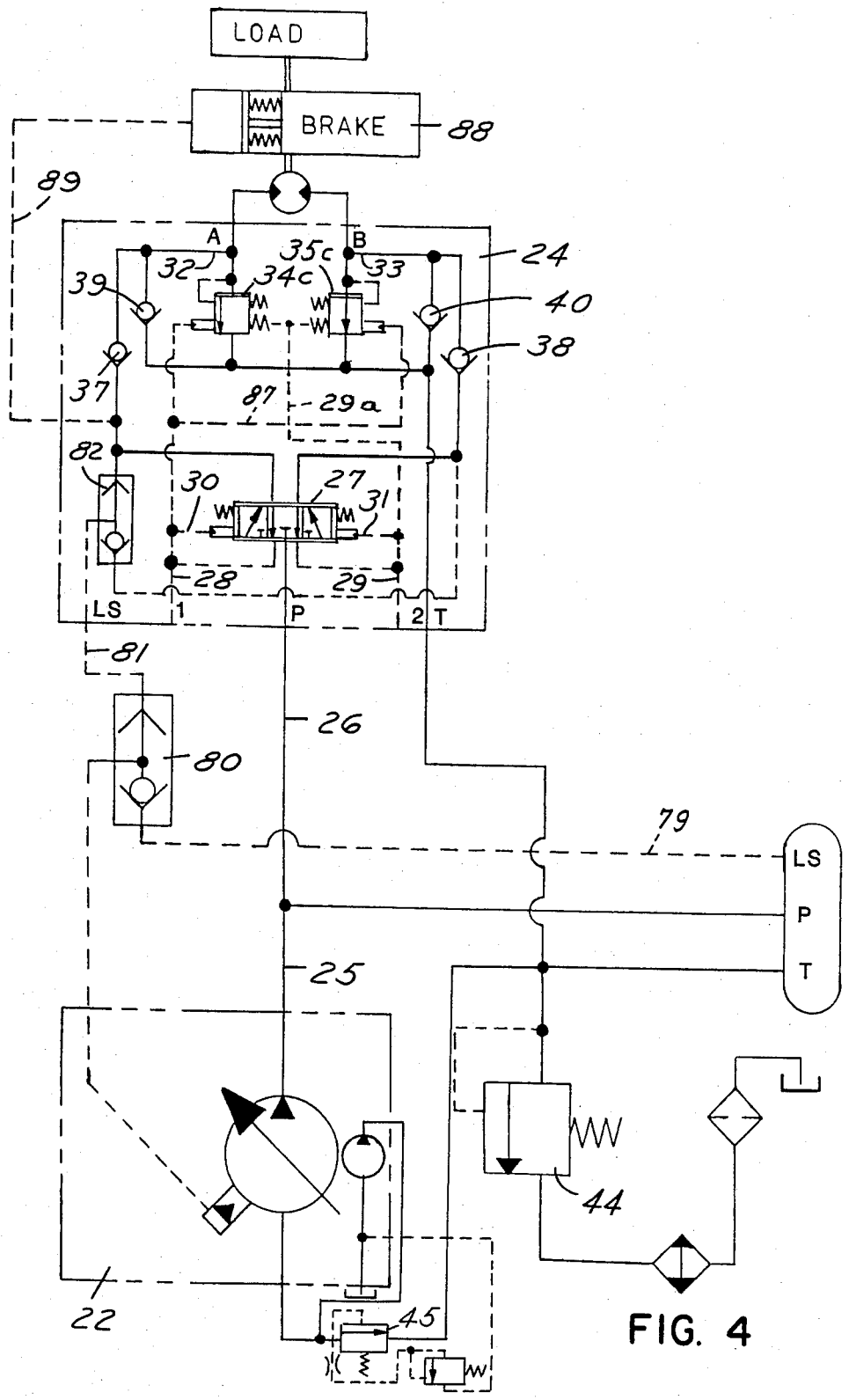
FIG. 4 is a schematic drawing of another modified hydraulic circuit.

In accordance with the invention, one or both of the valves 34, 35 is a normally open exhaust valve rather than normally closed meter-out valves as in the aforementioned United States patent. In the case where both exhaust valves are normally open as shown in FIGS. 1 and 2 the exhaust valves are vented, as presently described, through vent lines **47*a* or 48*a*. Where only one exhaust valve is normally open, as shown in FIGS. 3 and 4 both the exhaust valve 35*b* or 35*c* and the normally closed meter-out valve 34*b* or 34*c* are vented through a common vent line 29*a***.

Thus, as shown in FIG. 1, both exhaust valves 34, 35 are normally open so that the actuator will be free to move, as in the case of a swinging boom, when the meter-in valve is in a neutral position. However, when a pilot signal is provided to move the actuator in one direction, pilot pressure is applied through lines 47, 48 to close the appropriate exhaust valve.

Thus, when a pilot signal is applied to the meter-in valve to move the actuator in one direction, the exhaust valve associated with the port to the actuator through which fluid is to be supplied is closed by the pilot signal. When the meter-in valve is returned to a neutral position, the exhaust valve is returned to its normally open position and the actuator is permitted to have a float position in the case of a hydraulic cylinder or to have a free swing or coast position in the case of a rotary hydraulic motor.

Although the invention has been described in connection with a flow control meter-in valve system in FIG. 1, it may also be utilized in a pressure control meter-in valve system as shown in FIG. 2. As shown in FIG. 2, a pressure control meter-in valve system has feedback pressure of line 83 opposing the pilot pressure at 31 and feedback pressure of line 84 opposing pilot pressure applied at 30. This gives smoother stopping and starting of loads and accurate positioning of loads which would otherwise not be obtained with the flow control meter-in valve system.

Where the system is used in an environment requiring a counterbalance valve 85, as shown in FIG. 3, between one port of the actuator and an exhaust valve 35*b*, only one normally open exhaust valve 35*b* is provided and the meter-out valve 34*b* associated with the other actuator port is normally closed. Thus, the counterbalance valve 85 can function to control overrunning loads by limiting the flow through the valve. When the meter-in valve is actuated by a pilot signal to elevate the actuator, fluid can flow through the check valve of the counterbalance valve 85 to the actuator. At the same time, a pilot signal through line 87 closes exhaust valve 35*b*. Meter-out valve 34*b* functions in a conventional manner to allow exhaust from the other port of the actuator.

Where an external brake 88 is used as in FIG. 4 to control overrunning loads, similarly only one normally open exhaust valve 35*c* is provided and is associated with one port of the rotary hydraulic actuator while a normally closed meter-out valve 34*c* is associated with the other port. A line 89 extends from brake 88 to the load line associated with the other port.

Figure 5:
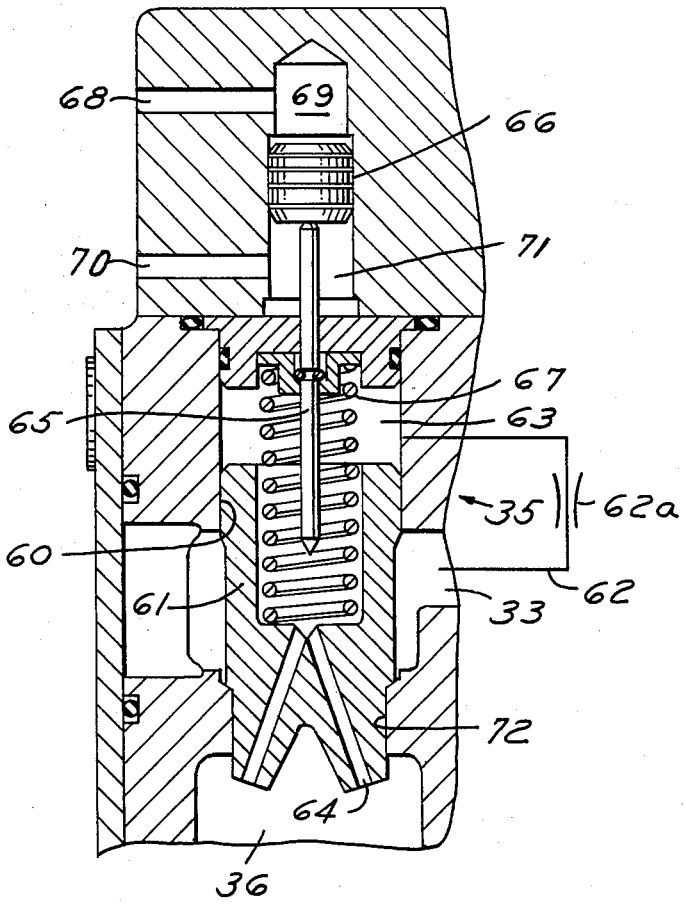
FIG. 5 is a fragmentary sectional view of a meter-out valve utilized in the system.

Referring to FIG. 5, each normally open exhaust valve 34, 35, 35*b*, 35*c* is of identical construction and, for purposes of clarity, only valve 35 is described.

The exhaust valve 35 includes a differential area bores 60 and 72 in which a poppet 61 is positioned between supply passage 33 and tank passage 36. The valve includes a passage 62 having an orifice 62*a* extending from supply passage 33 to a chamber 63 behind the poppet. One or more passages 64 formed within the poppet 61 extend from chamber 63 to the tank passage 36. A stem 65 is adapted to close the connection between chamber 63 and passages 64 under the action of a pilot pressure piston 66 which is positioned between chambers 69 and 71. A spring 67, in the absence of any pressure in the system, holds stem 65 in the open position and yieldingly urges poppet 61 to the closed position as shown in FIG. 5. However, in use the valve functions as a normally open valve; to this end the orifice 62*a*, the spring rate of spring 67, and the differential area of the poppet 66, i.e. the area of bore 60 less the area of bore 72, are selected so that a small and relatively insignificant pressure in line 33 will cause the poppet 61 to open and provide a flow path between passage 33 and tank passage 36. A passage 68 connects chamber 69 to pilot pressure in pilot line 28. The pressure in chamber 69 acts on one end of piston 66. Chamber 71, which is at the other end of piston 66, is vented through a passage 70, which as previously mentioned, connects with the appropriate vent line 48*a* or 29*a* as shown in FIGS. 1–4.

In accordance with another aspect of the invention as shown in FIGS. 6–9, the hydraulic control system is arranged so that both meter-out valves are closed in the normal fashion as described in U.S. Pat. No. 4,201,052 wherein the meter-in valve 27 is alternately supplied with pilot pressure for controlling the direction and displacement and movement of the meter-in valve and the direction and velocity of the actuator. A pair of lines 32, 33 extend from the meter-in valve 27 to the respective openings A, B of the actuator and a meter-out valve 34, 35 is associated with each line of the actuator controlling the flow out of the actuator when that line to the actuator does not have pressure fluid from the pump applied thereto. The meter-out valves are pilot operated and spring loaded poppet valves 37, 38 are provided in lines 32, 33 and spring loaded anti-cavitation valves 39, 40 open lines 32, 33 to tank passage 36. In addition, spring loaded poppet valves 41, 42 are associated with the respective meter-out valve 34, 35 and act with the meter-out valves as relief valves. Pilot control line 28 is connected to pilot piston 77 and pilot control line 29 is connected to pilot piston 78. Each of the meter-out valves has associated therewith a spring loaded pilot spool 71 which functions when the load pressure in passage 32 exceeds a predetermined value to open a flow path from the load through a control orifice 62 to the tank passage 36 through an intermediate passage 73. This bleed flow reduces the pressure and closing force on the left end of the poppet valve 61 permitting the valve 61 to move to the left and allowing flow from passage 32 to the return or tank line 36.

Figure 9:
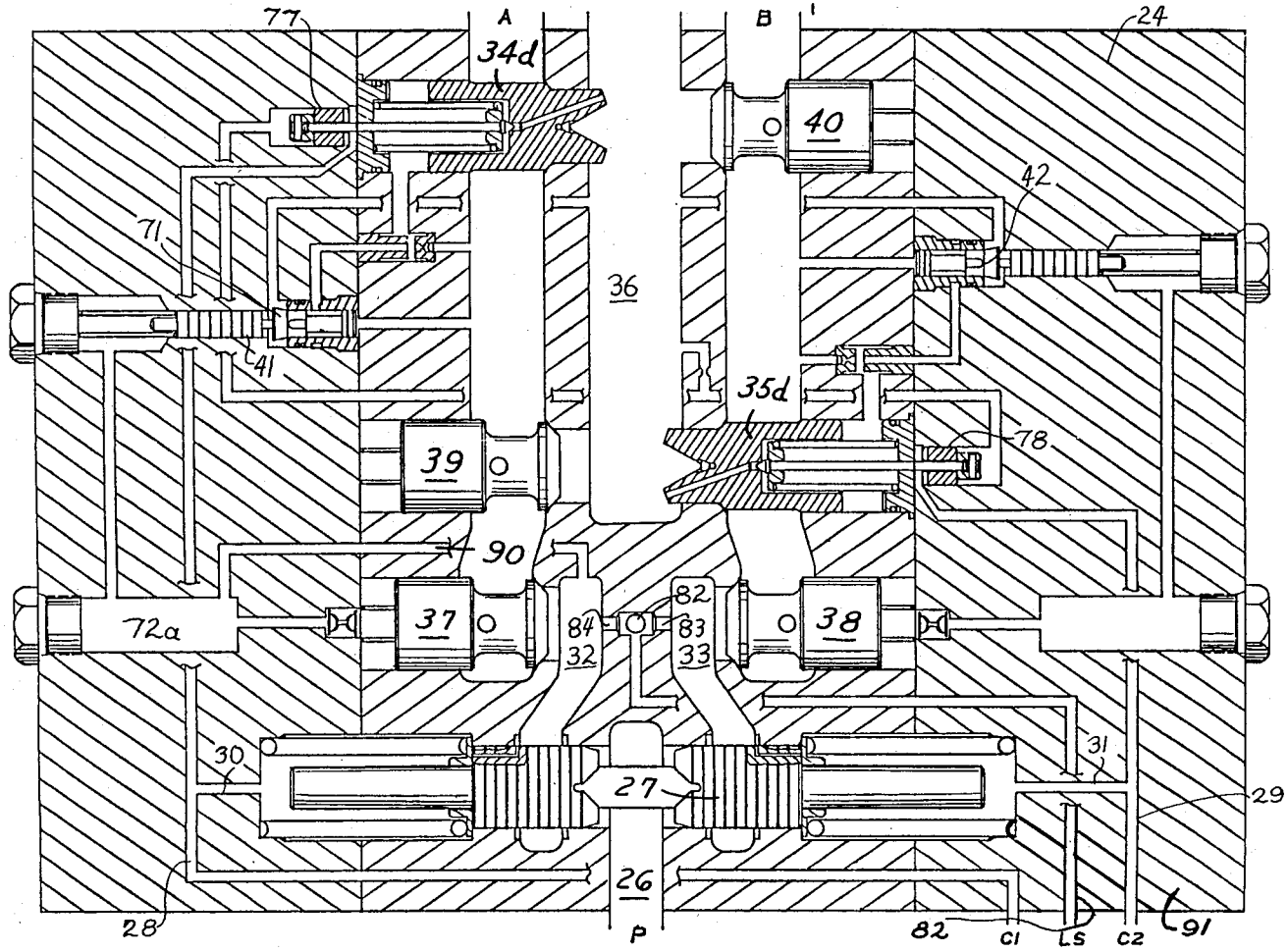
FIG. 9 is a sectional view of a hydraulic valve embodying the hydraulic circuit of FIG. 6.

In accordance with the invention as shown in FIG. 9, a passage 90 is added from line 32 to the accumulator volume and thereby to the spring cavity of the pilot relief valve 41. This passage 90 acts, when meter-in-valve 27 is centered, that is, pilot pressures are zero, to reduce the pressure holding the pilot relief valve 41 closed, and allowing it to open when a relatively low (approximately 200 psi) pressure is developed at opening A. Opening of the pilot relief valve 41, in turn, bleeds off the pressure holding the meter-out valve 34*d* closed, and thus allows the pressure at opening A to open this meter-out valve 34*d*, allowing flow from opening A to tank.

Figure 6:
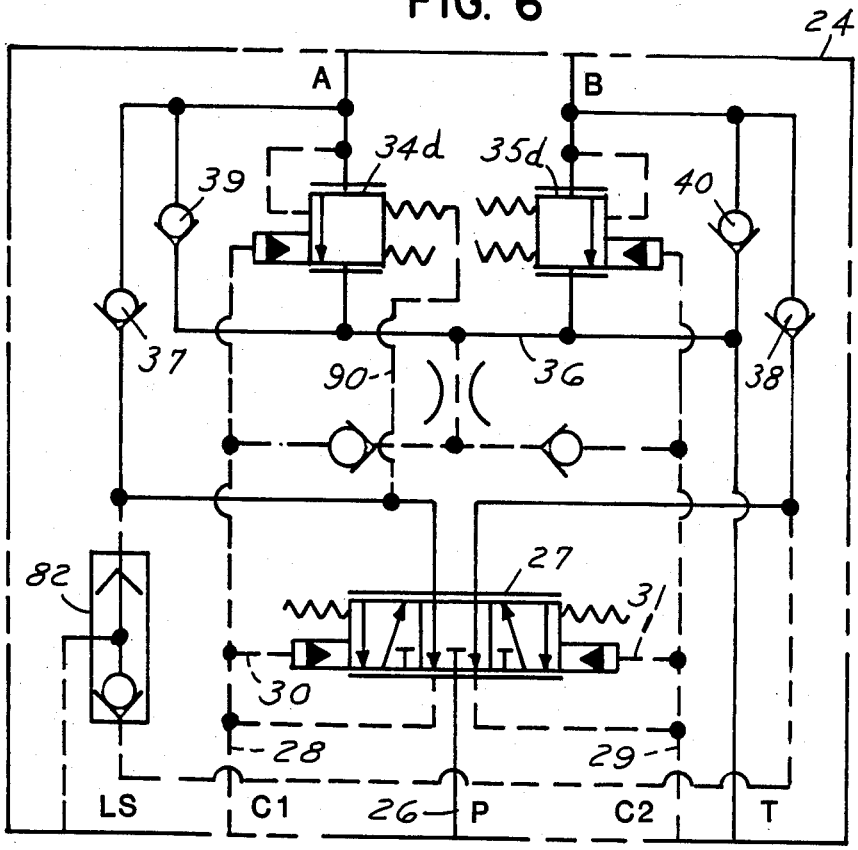
FIG. 6 is a schematic drawing of another modified hydraulic circuit.
Figure 7:
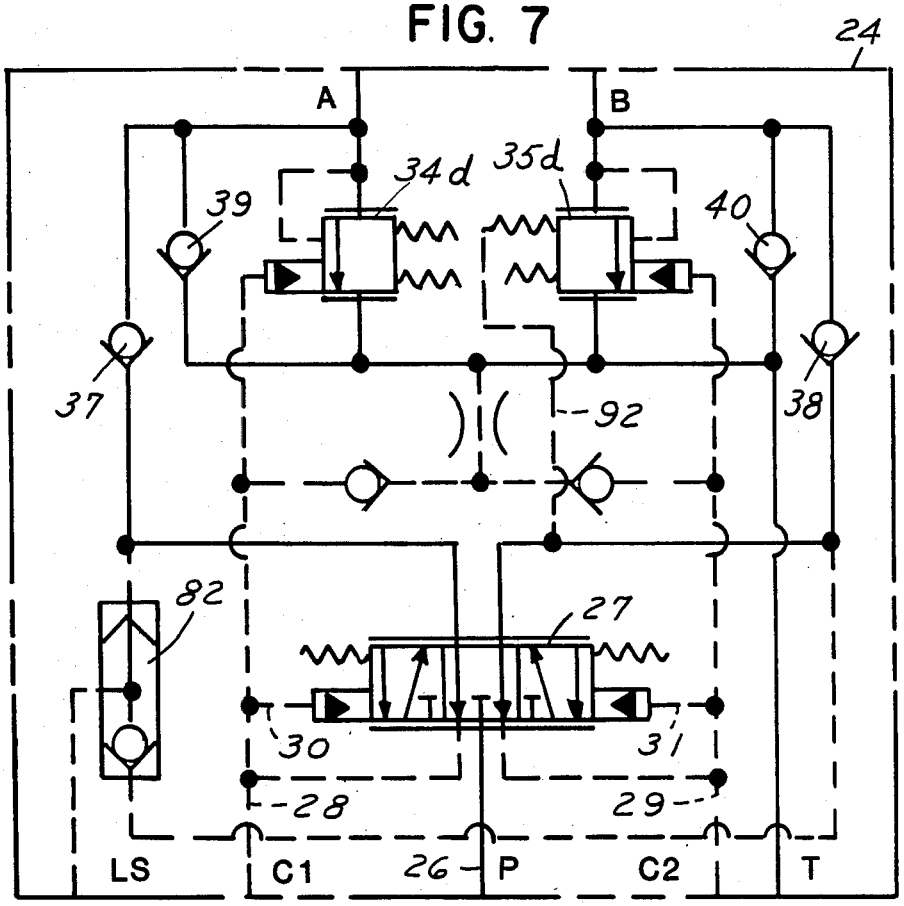
FIG. 7 is a schematic drawing of another modified circuit.
Figure 8:
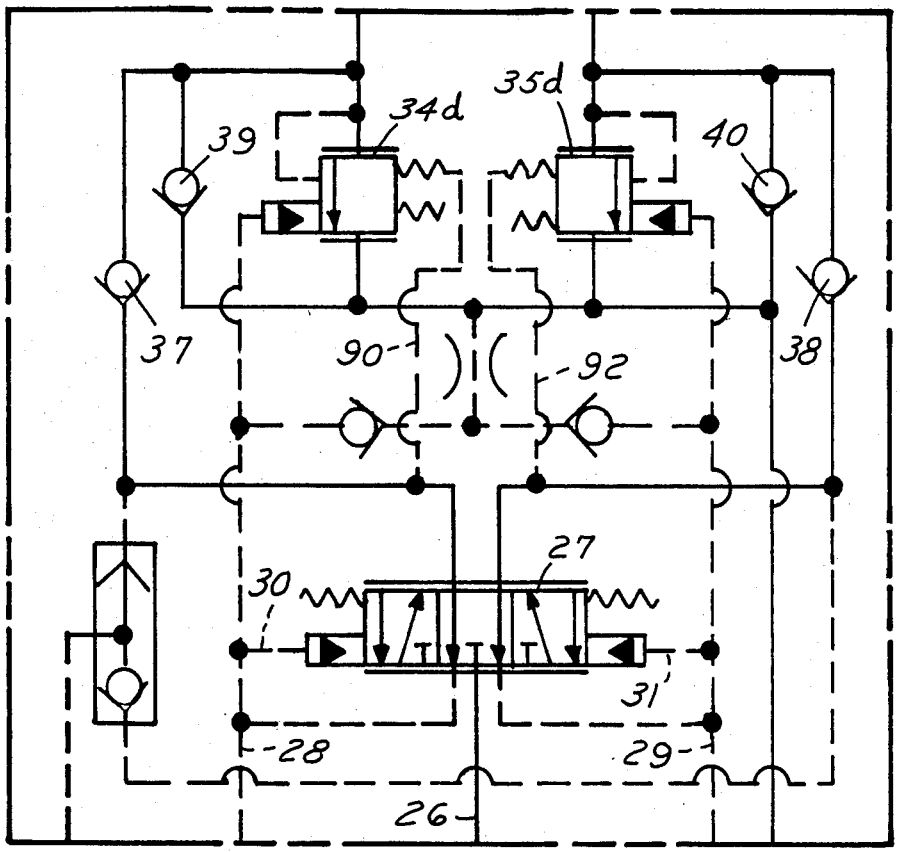
FIG. 8 is a schematic drawing of another modified hydraulic circuit.

FIGS. 6, 7 and 8 are simplified schematics to the extent that the pilot relief valves 41 are not shown but are represented by a spring and by a pass line.

FIG. 8 shows an arrangement where both meter-out valves 34*d*, 35*d* have comparable passages 90, 92 which function in the absence of any pilot pressure to bleed off pressure holding their respective poppets closed, thus allowing them to open in response to low pressures at openings A or B.

What is claimed is:

1. A hydraulic control system comprising a hydraulic actuator having a movable element and opposed actuator openings adapted to alternatively function as inlets and outlets for moving the element of the actuator in opposite directions, a pump for supplying fluid to said actuator, a tank passage for returning fluid to a reservoir, pilot operated meter-in valve means to which the fluid from the pump is supplied, said meter-in valve means being pilot pressure controlled by alternately supplying fluid at pilot pressure to said meter-in valve means for directing fluid from the pump and controlling the direction of movement of the actuator, pilot pressure operated meter-out valve means associated with each opening of the actuator and positioned between said tank passage and each hydraulic line to each opening of the actuator for controlling the flow of fluid therebetween, a pair of lines extending from said meter-in valve means to said respective openings of said actuator such that when said meter-in valve means is operated by pilot pressure to supply fluid through one of said lines to one of said openings of the actuator, pilot pressure also functions to control the opening of the other meter-out valve means associated with the other of said openings to said actuator, a poppet valve operable as a load drop check valve in each said line operable to open when the pressure in the line exceeds a predetermined value, each said meter-out valve means having a normally closed spring loaded poppet valve associated therewith, each said poppet valve having a spring chamber biasing the poppet valve closed, and a passage extending from the spring chamber of one of said poppet valves associated with one of said meter-out valve means and connected to one of said pair of lines upstream of said load drop check valve in said line and operable, when the meter-in valve means is open to apply fluid pressure to said one of said lines and said passage to maintain the associated poppet valve closed, and operable when said meter-in valve means is closed after being open, to reduce the pressure holding the associated spring loaded poppet valve closed, thereby permitting the spring loaded poppet valve to open at a relatively low pressure developed in said one of said lines thereby allowing said one meter-out valve means to open.

2. The hydraulic control system set forth in claim 1 including a second passage extending from the spring chamber of the other poppet valve associated with the other meter-out valve means and connected to the other line upstream of said load drop check valve in said other line and operable, when the meter-in valve means is open to apply fluid pressure to said other of said lines and said second passage to maintain the other poppet valve closed, and operable when the meter-in valve means is closed after being open, to reduce the pressure holding the spring loaded poppet valve closed, thereby permitting the poppet valve to open at a relatively lower pressure developed in said other of said lines, thereby allowing said other meter-out valve means to open.

3. The hydraulic control system set forth in claim 1 wherein said meter-in valve means, meter-out valve means, pair of lines, spring loaded poppet valves and passage are provided in a valve body.

* * * * *